US007870728B2

(12) United States Patent
Keuper et al.

(10) Patent No.: US 7,870,728 B2
(45) Date of Patent: Jan. 18, 2011

(54) HYDRAULIC CONTROL ARRANGEMENT

(75) Inventors: Gerhard Keuper, Leonberg (DE); Peter Stachnik, Markgröningen (DE); Heinrich Loedige, Vaihingen (DE); Soenke Jessen, Tamm (DE)

(73) Assignee: Bosch Rexroth, AG, Stuttgart (DE)

( * ) Notice: Subject to any disclaimer, the term of this patent is extended or adjusted under 35 U.S.C. 154(b) by 674 days.

(21) Appl. No.: 11/576,648

(22) PCT Filed: Oct. 6, 2005

(86) PCT No.: PCT/DE2005/001792

§ 371 (c)(1),
(2), (4) Date: Dec. 10, 2007

(87) PCT Pub. No.: WO2006/037318

PCT Pub. Date: Apr. 13, 2006

(65) Prior Publication Data

US 2008/0202110 A1 Aug. 28, 2008

(30) Foreign Application Priority Data

Oct. 6, 2004 (DE) ..... 10 2004 048 684

(51) Int. Cl.
*F16D 31/02* (2006.01)

(52) U.S. Cl. ..... 60/422

(58) Field of Classification Search ..... 60/422, 60/468, 494; 91/516

See application file for complete search history.

(56) References Cited

U.S. PATENT DOCUMENTS

| | | | | |
|---|---|---|---|---|
| 4,335,577 | A | 6/1982 | Lobmeyer et al. | |
| 4,400,937 | A | 8/1983 | Lobmeyer et al. | |
| 4,977,928 | A | 12/1990 | Smith et al. | |
| 5,152,143 | A * | 10/1992 | Kajita et al. | 60/422 |
| 5,493,861 | A * | 2/1996 | Friedrichsen | 60/452 |
| 5,540,049 | A | 7/1996 | Lunzman et al. | |
| 6,405,529 | B1 * | 6/2002 | Berg et al. | 60/422 |
| 7,305,821 | B2 * | 12/2007 | Kobayashi et al. | 60/422 |

FOREIGN PATENT DOCUMENTS

| | | | |
|---|---|---|---|
| DE | 3629471 | A1 | 3/1988 |
| DE | 4127342 | A1 | 2/1993 |
| DE | 4239109 | C1 | 6/1994 |
| DE | 4433633 | | 7/1995 |
| DE | 10214850 | A1 | 10/2003 |
| EP | 0432266 | A | 6/1991 |
| EP | 0462589 | A1 | 12/1991 |
| EP | 1245834 | A | 10/2002 |

OTHER PUBLICATIONS

German Patent and Trademark Office, Search Report (Translation), Mar. 18, 2005, Serial No. 102004048684.0, 2 pages.

* cited by examiner

*Primary Examiner*—Michael Leslie
(74) *Attorney, Agent, or Firm*—Boyle Fredrickson, S.C.

(57) ABSTRACT

The invention discloses a hydraulic control arrangement for controlling a number of consumers, particularly of a mobile working machine. In addition to the consumers of the control arrangement, an additional consumer should be able to be connected to a power beyond port. All consumers and power beyond consumers are supplied with hydraulic fluid by a pump. An input pressure scale is provided downstream of the pump, and the greater of the load pressures of the consumers or of the at least one power beyond consumer is applied to the control port of said input pressure scale.

18 Claims, 9 Drawing Sheets

HYDRAULIC CONTROL ARRANGEMENT

BACKGROUND OF THE INVENTION

1. Field of the Invention

The invention relates to a hydraulic control arrangement for controlling a number of consumers in accordance with the preamble of claim 1 as well as to a control method for a hydraulic control arrangement of this type.

2. Description of Related Art

Such hydraulic control arrangements are used especially in mobile working machines, for instance wheel loaders or tractors, in order to supply the consumers thereof, for instance the working hydraulics, the steering system or the traveling drives as well as ancillary equipment with hydraulic fluid.

From U.S. Pat. No. 5,540,049 a closed-center system is known in which the hydraulic fluid supply is carried out by means of an electrically controlled variable-displacement pump. A bypass valve by means of which a connection to the tank can be opened is allocated to the variable-displacement pump. The variable-displacement pump, the bypass valve and closed-center valves connected upstream of the consumer are controlled electrically by means of control devices, inter alia in response to the pump pressure and the travel distance of one of the valve slides of the closed-center valves. Thus, in this known solution an electronic velocity or power control of the consumers is performed.

From EP 0 462 589 B1, EP 0 432 266 B2 and DE 41 27 342 C2 hydraulic control arrangements are known which are in the form of a LS system. In such LS systems the pump capacity of the pump is controlled such that a pump pressure lying above the maximum load pressure of the consumers by a defined pressure difference $\Delta p$ is prevailing in the pump line. In the known systems an adjustable metering orifice and an individual pressure scale by which the hydraulic fluid volume flow to the consumer can be kept constant in response to the adjustment of the metering orifice in a load-independent manner are allocated to each consumer. In said LS systems an input pressure scale by means of which a connection to the tank can be opened can be provided downstream of the pump. A control pressure corresponding to the maximum load pressure is applied to said input pressure scales in the closing direction. The pressure difference at which the input pressure scale opens is usually slightly greater than $\Delta p$ adjusted by the pump.

For connecting mounted implements or ancillary equipment without an independent hydraulic fluid supply a power-beyond port, as it is called, is provided which may include a pressure line, a return line and a LS line. Said power-beyond port permits the use of the load-sensing system of the working machine also for the mounting implement. Such solutions are known, for instance, from DE 102 14 850 A1 and DE 42 39 109 C1.

It is a problem in hydraulic control arrangements provided with power-beyond ports that no information about the required hydraulic fluid volume flow of the consumer or consumers connected to the power-beyond port (power-beyond consumers) is provided. In the case of a lack of supply in the system an uncontrolled behavior of one or more consumers may occur depending on the load pressure. In this case it is usually not possible to reduce individual consumers of the system in a well-directed manner in order to operate other priority consumers in a desired manner.

Compared to this, the object underlying the invention is to provide a control method and a hydraulic control arrangement in which, when at least one power-beyond consumer is connected to a power-beyond port, a hydraulic fluid supply of all consumers is improved vis-à-vis the known solutions.

OBJECT OF THE INVENTION

This object is achieved by a hydraulic control arrangement comprising the features of claim 1 and a control method according to claim 17.

In accordance with the invention, the hydraulic control arrangement comprises a pump whose displacement rate is variable and by which at least one consumer can be supplied with hydraulic fluid. A metering orifice via which the hydraulic fluid volume flow to the consumer is adjusted is arranged upstream of the consumer. An input pressure scale by which a connection to a tank line leading to a tank can be opened is connected downstream of the pump. The control arrangement moreover has a power beyond port to which a power beyond consumer is connected. According to the invention, the input pressure scale is controlled in response to the greatest of the load pressures prevailing at the consumers of the control arrangement and at the power beyond consumers. That is to say, the load pressure of the power beyond consumer is used for adjusting the input pressure scale defining the pressure in a pump or advance line so that an interference by the power beyond consumer is almost excluded by the appropriate adjustment of the input pressure scale. Such interferences occur in the prior art described in the beginning especially in the case of low load pressure and large hydraulic fluid volume flow.

According to the concept of control in accordance with the invention, for avoiding a lack of supply the pump and/or the metering orifices of the consumers are controlled such that a predetermined residual volume flow toward the tank is adjusted when the power beyond consumer is supplied via the input pressure scale. The pump can be adjusted in response to the adjustment of the input pressure scale. This can be done, for instance, by measuring the residual volume flow or by sensing the position of a slide of the input pressure scale.

In accordance with the invention, the hydraulic fluid is supplied to the power beyond consumers either through the input pressure scale or through power beyond individual pressure scales.

In the first-mentioned alternative, the greatest one of the load pressures is preferably applied to the input pressure scale in the closing direction.

The input pressure scale is designed in such manner in a preferred embodiment that in a spring-biased home position the connection to the priority consumer and to the tank is blocked and upon adjusting the input pressure scale in the opening direction first the connection to the priority consumer and then the connection to the tank can be opened. A sufficient supply of the priority consumer is ensured when said residual volume flow drains to the tank.

In case that a second one or a number of power beyond consumers are connected, they can be supplied with hydraulic fluid via the input pressure scale either simultaneously or in a predetermined order of priority. For setting a priority a power beyond pressure scale, to which in the closing direction the force of a spring and the same control pressure as to the input pressure scale is applied and in the opening direction the pressure prevailing at the input of the power beyond pressure scale is applied, can be connected upstream of the second power beyond consumer, for instance. I.e. said power beyond pressure scale opens only when the hydraulic fluid supply of the first-mentioned power beyond consumer is ensured.

In the second concept according to the invention in which the power beyond consumers are not supplied with hydraulic fluid via the input pressure scale but via the power beyond pressure scales, in a variant according to the invention the greatest one of the load pressures is applied to the input pressure scale and the power beyond pressure scale in the closing direction.

It may be advantageous in this context to connect the input pressure scale downstream of the power beyond pressure scale so that then the input pressure scale is connected to the output of the power beyond pressure scale practically in parallel to the power beyond consumer.

In an alternative variant of solution, the greatest one of the load pressures is applied to the input pressure scale and the power beyond pressure scale in the opening direction.

Further possible solutions consist in the fact that the greatest one of the load pressures is applied to the input pressure scale and a diaphragm is provided between the output of the input pressure scale and the tank, wherein the pressure upstream of said diaphragm acts in the opening direction upon the power beyond pressure scale via which the power beyond consumer or consumers is/are supplied with hydraulic fluid.

As an alternative, the greatest one of the load pressures can also be applied to the input pressure scale in the opening direction, wherein then the pressure downstream of the diaphragm likewise acts in the opening direction upon the power beyond pressure scale.

The pump may be an electrically controllable variable-displacement pump or a speed-controlled constant-displacement pump.

It is preferred according to the invention when the hydraulic control arrangement is an LS system, wherein an individual pressure scale is connected upstream of each metering orifice allocated to a consumer.

The springs of the individual pressure scales allocated to the consumers, of the power beyond pressure scales allocated to the power beyond consumers and of the input pressure scale are adapted to one another such that priority is given either to consumers or to power beyond consumers.

In accordance with the invention, the opening pressure difference of the input pressure scale is adjusted to be greater than the opening pressure difference of the individual pressure scales and the power beyond pressure scales, wherein the opening pressure difference above the power beyond pressure scales may be selected to be greater or smaller than that above the individual pressure scales depending on the priority treatment.

The metering orifices can be adjusted electrically, hydraulically or mechanically.

The greatest one of the load pressures is preferably tapped off by means of a shuttle valve to the one input of which the greatest load pressure of the consumers is applied and to the other input of which the greatest load pressure of the power beyond consumers is applied so that at the output the greater of said load pressures is tapped off and guided to the input pressure scale.

Other advantageous developments of the invention are the subject matter of further subclaims.

BRIEF DESCRIPTION OF THE DRAWINGS

Hereinafter preferred embodiments of the invention will be illustrated in detail by way of schematic drawings, in which.

DETAILED DESCRIPTION OF THE PREFERRED EMBODIMENT

Figure 1:
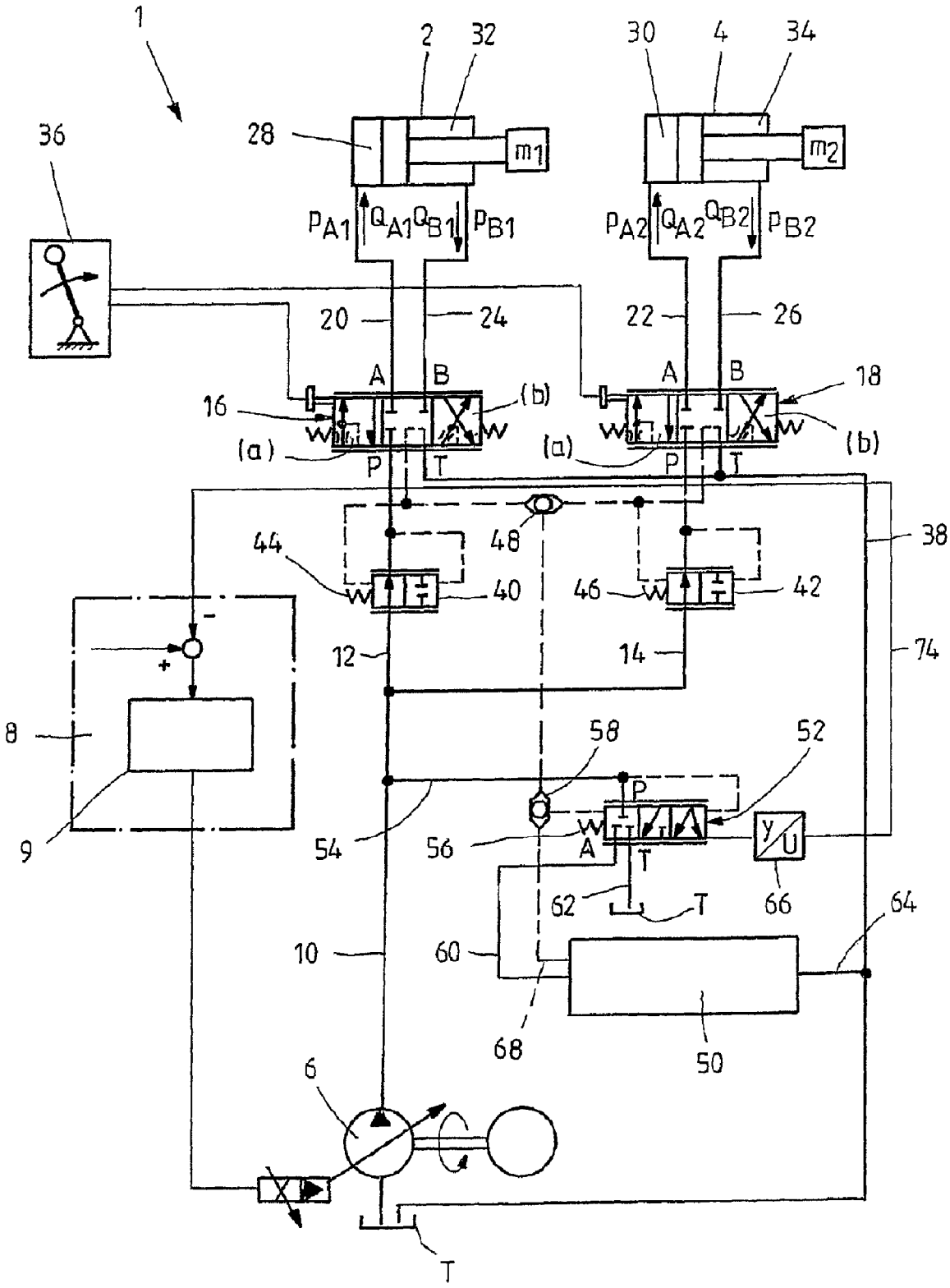
FIGS. 1, 2 and 3 show embodiments of control arrangements according to the invention in which power beyond consumers can be supplied with hydraulic fluid via an input pressure scale

FIG. 1 shows a hydraulic control arrangement 1 of a mobile working machine, for instance an agricultural tractor. Said control arrangement can be formed, for instance, by a mobile control block by means of which the hydraulic consumers of the working hydraulics of the working machine, in the present case two double-acting cylinders 2, 4, can be supplied with hydraulic fluid which is supplied by a pump 6 and is returned from the consumers to a tank T. In the shown embodiment the pump 6 is an electrically controllable variable-displacement pump whose swivel angle is adjustable via a pump controller 8. Instead of an electrically controllable variable-displacement pump, also a speed-controlled constant-displacement pump or the like can be employed.

The hydraulic fluid sucked from the tank T is fed into a pump line 10 which branches in two feed lines 12, 14, the feed line 12 being allocated to the cylinder 2 and the feed line 14 being allocated to the cylinder 4. I.e. the hydraulic fluid volume flow $Q_{VW}$ supplied by the pump 6 is branched into partial hydraulic fluid volume flows $Q_{VW1}$ and $Q_{VW2}$. The feed lines 12, 14 are connected to a respective inlet port P of a continuously variable directional control valve 16 and 18 by which the hydraulic fluid flow direction to and from the consumer and the hydraulic fluid volume flow are adjustable. Feed lines 20 and 22 and return lines 24 and 26 are connected to the working ports A, B of the directional control valves 16, 18, wherein the feed lines 20, 22 are connected to a bottom-side cylinder chamber 28 and 30 and the return lines 24, 26 are connected to a piston rod side annular chamber 32 and 34 of the cylinders 2, 4. Upon a respective actuation of the directional control valve 16, 18 the line denoted with feed or return line can also act as return or feed line, of course.

The two directional control valves 16, 18 are actuated via one or more pilot-operated devices 36 by which a control pressure can be applied to control chambers of the directional control valves 16, 18 so as to change the valve slide from its shown blocking position (closed center) into the indicated positions (a) or (b) in which either the cylinder chamber 28, 30 or the annular chamber 32, 34 is supplied with hydraulic fluid, while the hydraulic fluid is then displaced from the respective other pressure chamber. In so doing, by means of a feed control edge a feed metering orifice is opened whose opening cross-section defines the hydraulic fluid volume flow to the cylinder 2, 4. The hydraulic fluid flowing back from the cylinder 2, 4 is returned via a tank port T and a tank line 38 connected thereto to the tank T.

In the illustrated embodiment a respective load m1 and/or m2 is moved via the two cylinders 2, 4. In FIG. 1 the hydraulic fluid volume flow incoming through the feed lines 20, 22 is denoted with $Q_{A1}$, $Q_{A2}$ and the draining hydraulic fluid volume flow is denoted with $Q_{B1}$ and/or $Q_{B2}$. In the lines the respective marked pressures $p_{A1}$, $p_{B1}$, $p_{A2}$ and $p_{R2}$ are prevailing.

Upstream of each directional control valve 16, 18 in the respective feed line 12 or 14 a LS or individual pressure scale 40, 42 is provided to which the force of a respective pressure scale spring 44 or 46 as well as the load pressure prevailing at the respective consumer 2, 4 is applied in the opening direction. In the closing direction the respective pressure prevailing in the hydraulic fluid flow path between the output of the respective individual pressure scale 40, 42 and the input of the connected directional control valve 16, 18 acts upon the pressure scale slides of the individual pressure scales 40, 42. By the respective individual pressure scale 40, 42 and the allocated metering orifice formed by the directional control valve 16, 18 a current regulator is formed by which the pressure drop above the metering orifice can be kept constant in a load-independent manner.

The control arrangement moreover comprises an input pressure scale 52 disposed in a branch line 54 branching off the pump line 10. By means of the input pressure scale 52 a connection to the tank T can be opened.

Up to this point the control arrangement 1 according to the invention substantially corresponds to the structure as described in the prior art mentioned in the beginning.

For connecting a device having an additional hydraulic consumer to the mobile working machine, for instance a forage wagon or a potato harvester, the system is provided with a power beyond port to which said additional consumer, hereinafter referred to as power beyond consumer 50, can be connected.

In the illustrated embodiment the input pressure scale 52 is in the form of a 3/3 port directional pressure scale to the slide of which the force of a spring 56 as well as the pressure prevailing at the output of a pressure scale shuttle valve 58 are applied in the opening direction and the pressure prevailing in the branch line 54 and thus the pressure prevailing in the pump line 10 is applied in the closing direction. At the inputs of the pressure scale shuttle valve 58, on the one hand the greatest load pressure of the two consumers 2, 4 is prevailing which is tapped off by the directional control valves 16, 18 via a shuttle valve 48 and corresponding load reporting lines. At the other input of the pressure scale shuttle valve 58 the load pressure of the power beyond consumer 50 is prevailing which is tapped off via a power beyond load reporting line 68. The greatest one of the load pressures applied to the consumers 2, 4 and to the power beyond consumer 50 is applied to the pressure scale slide of the input pressure scale 52 in the closing direction. The power beyond consumer 50 is connected to a working port A of the 3/3 port directional pressure scale via a feed duct 60. The hydraulic fluid draining from the power beyond consumer 50 is guided into the tank line 38 via a drain duct 64. A tank duct 62 leading to the tank T is connected to the tank port T of the input pressure scale 52.

The opening pressure difference $\Delta p_{EDW}$ which has to be applied for completely opening the input pressure scale 52 is defined by the force of the spring 56. In the shown embodiment the travel distance of the valve slide of the input pressure scale 52 is detected by a distance sensor 66 and converted into a signal applied to a signal input of the pump regulator so that the pump is adjusted in response to the travel distance of the pressure scale slide of the input pressure scale 52.

In the case of a non-actuated or non-connected power beyond consumer 50 the input pressure scale 52 is closed and the working hydraulics of the tractor (cylinder 2, 4) is supplied which hydraulic fluid. The input pressure scale 52 is adjusted in the opening direction upon actuation of the power beyond consumer 3 so that the latter can be supplied with hydraulic fluid. The pump 6 is adjusted in response to the travel distance of the pressure scale slide of the input pressure scale 52 such that a small residual volume flow drains through the tank port T—(the input pressure scale 52 is then opened toward the power beyond consumer 50 and toward the tank T). It is ensured in this way that all consumers 2, 4 and the power beyond consumer 50 are sufficiently supplied with hydraulic fluid. In the shown embodiment the pump 6 is controlled in response to the travel distance of the pressure scale slide of the input pressure scale 52, as an alternative also the residual volume flow draining toward the tank T could be detected and used for adjusting the pump 6. In the pump regulator 8 the signal $Y_{EDWist}$ corresponding to the actual travel of the pressure scale slide is compared to a desired value stored in a data memory—then the pump 6 is adjusted in response to this control deviation by means of a control algorithm 9.

As a rule, in this embodiment the opening pressure difference of the input pressure scale 52 will be greater than the opening pressure difference of the individual pressure scales 40, 42, i.e. the spring 56 is stronger than the pressure scale springs 44, 46.

The embodiments described in the following differ from the above-described embodiment merely by the way in which the input pressure scale 52 is designed and in which the power beyond consumer(s) is/are controlled. Therefore the description of the consumers 2, 4, the allocated directional control valves 16, 18 and the individual pressure scales 40, 42 can be dispensed with, they are designed in the following embodiments just as in the afore-described embodiment.

Figure 2:
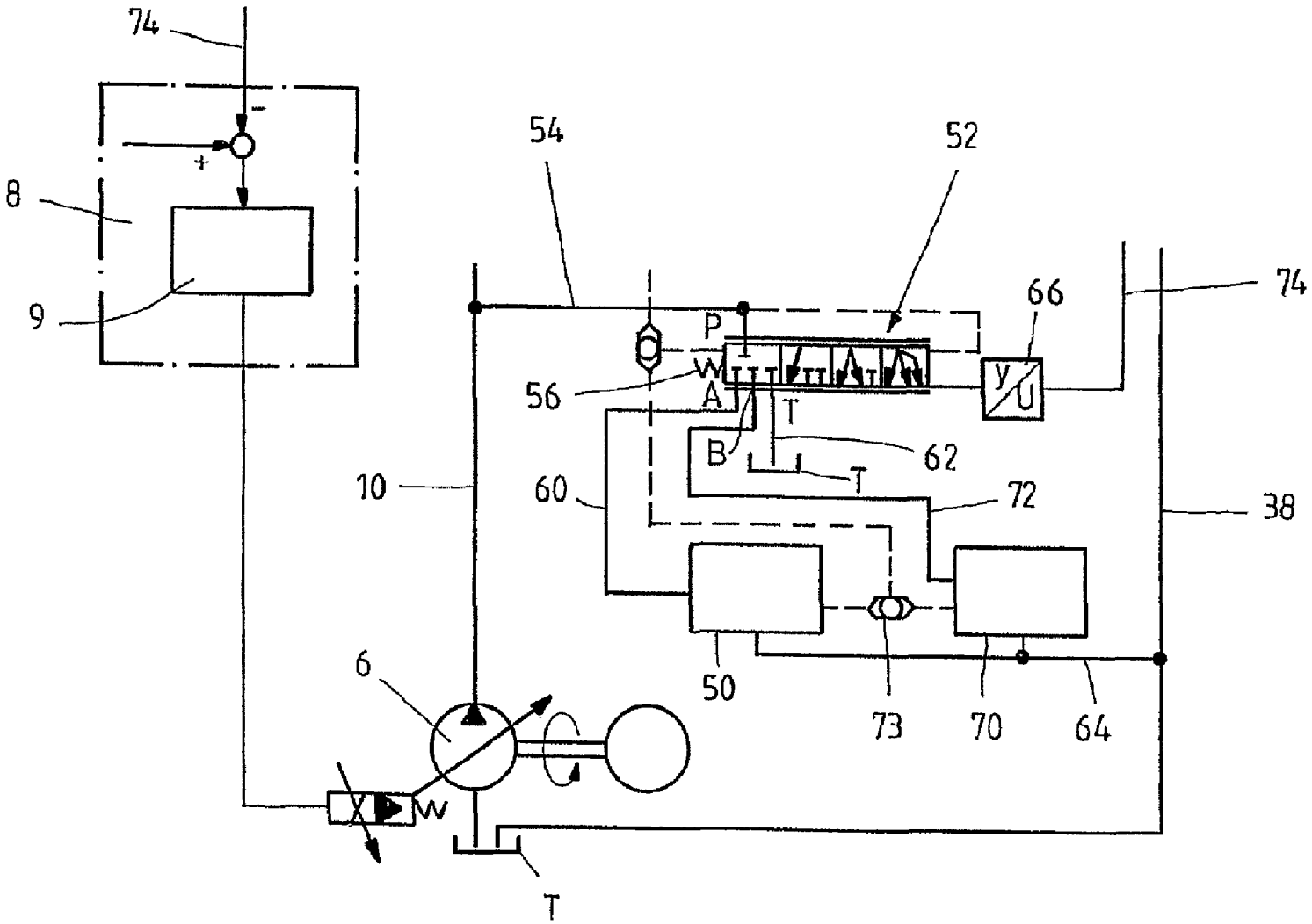

The embodiment shown in FIG. 2 basically corresponds to the solution represented in FIG. 1, wherein two power beyond consumers 50, 70 are controlled instead of one single consumer, however. The input pressure scale 52 is a 4/4 port directional pressure scale, the input port P of the input pressure scale 52 being connected to the branch line 54, while the two power beyond consumers 50, 70 are supplied with hydraulic fluid through the feed duct 60 and a further feed duct 72, respectively, which are connected to two output ports A, B of the pressure scale 52. The force of the spring 56 and the greatest load pressure of the consumers 2, 4 and the two power beyond consumers 50, 70 in turn are applied to the input pressure scale 52 in the closing direction, the greater of the load pressures of the two power beyond consumers 50, 70 being tapped off by means of a power beyond shuttle valve 73. In the opening direction the pressure prevailing at the input port P in turn is applied to the input pressure scale 52. The input pressure scale 52 is designed such that the input pressure scale 52 is blocked upon non-actuation or non-connection of the power beyond consumers 50, 70. Upon actuation of the two power beyond consumers 50, 70 first the power beyond consumer 50 is supplied with hydraulic fluid and upon a further displacement of the pressure scale slide the connection to the further power beyond consumer 70 is opened. That is to say, in this solution shown in FIG. 2 the power beyond consumer 50 is treated with priority over the power beyond consumer 70. In the case of a completely opened input pressure scale 52 a residual volume flow drains to the tank T through the tank duct 62. The travel distance of the pressure scale slide is detected, as in the afore-described embodiment, by the distance sensor 66 and is guided via a signal line 74 to a signal terminal of the pump regulator 8 and processed in the manner described in the beginning—the pump 6 is adjusted in such a way that a predetermined residual volume flow drains to the tank T so that a sufficient supply of all consumers and the power beyond consumers 50, 70 is ensured.

Figure 3:
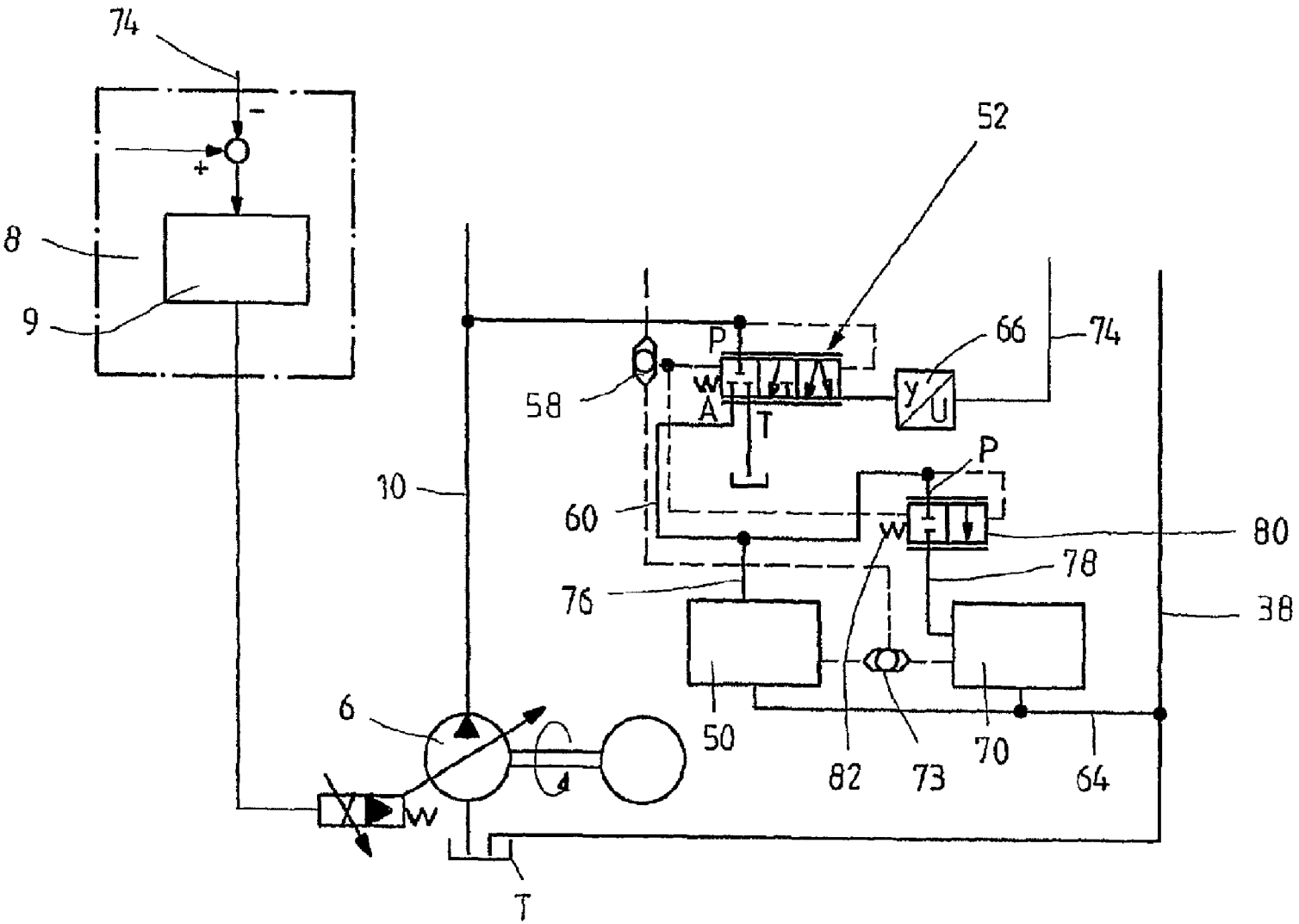

In the embodiment represented in FIG. 3 the same input pressure scale 52 is used as in the embodiment according to FIG. 1 by which two power beyond consumers 50, 70 can be supplied with hydraulic fluid, however. To this end, the feed duct 60 connected to the output port A branches into two feed branch ducts 76, 78 by which the hydraulic fluid is guided to the power beyond consumer 50 and/or 70. In the feed branch duct 78 a power beyond pressure scale 80 is provided to which in the closing direction the force of a pressure scale spring 82 and the greatest one of the occurring load pressures tapped off by the output of the pressure scale shuttle valve 58 are applied. In the opening direction the pressure prevailing at the input port P of the power beyond pressure scale 80 is applied to the latter. The opening pressure of said power beyond pressure scale 80 is selected to be smaller than that of the input pressure scale 52 and the individual pressure scales 40, 42. By interaction of the input pressure scale 52 and the power beyond pressure scale 80 in this embodiment the power beyond consumer 50 is treated with priority over the power beyond consumer 70.

In the three afore-described embodiments the power beyond consumer(s) 50, 70 are always supplied with hydraulic fluid via the input pressure scale 52 disposed in the hydraulic fluid flow path between the pump line 10 and the allocated consumer 50, 70. In the embodiments described hereinafter the consumers are directly supplied with hydraulic fluid, i.e. while bypassing the input pressure scale 52 via allocated power beyond pressure scales.

Figure 4:
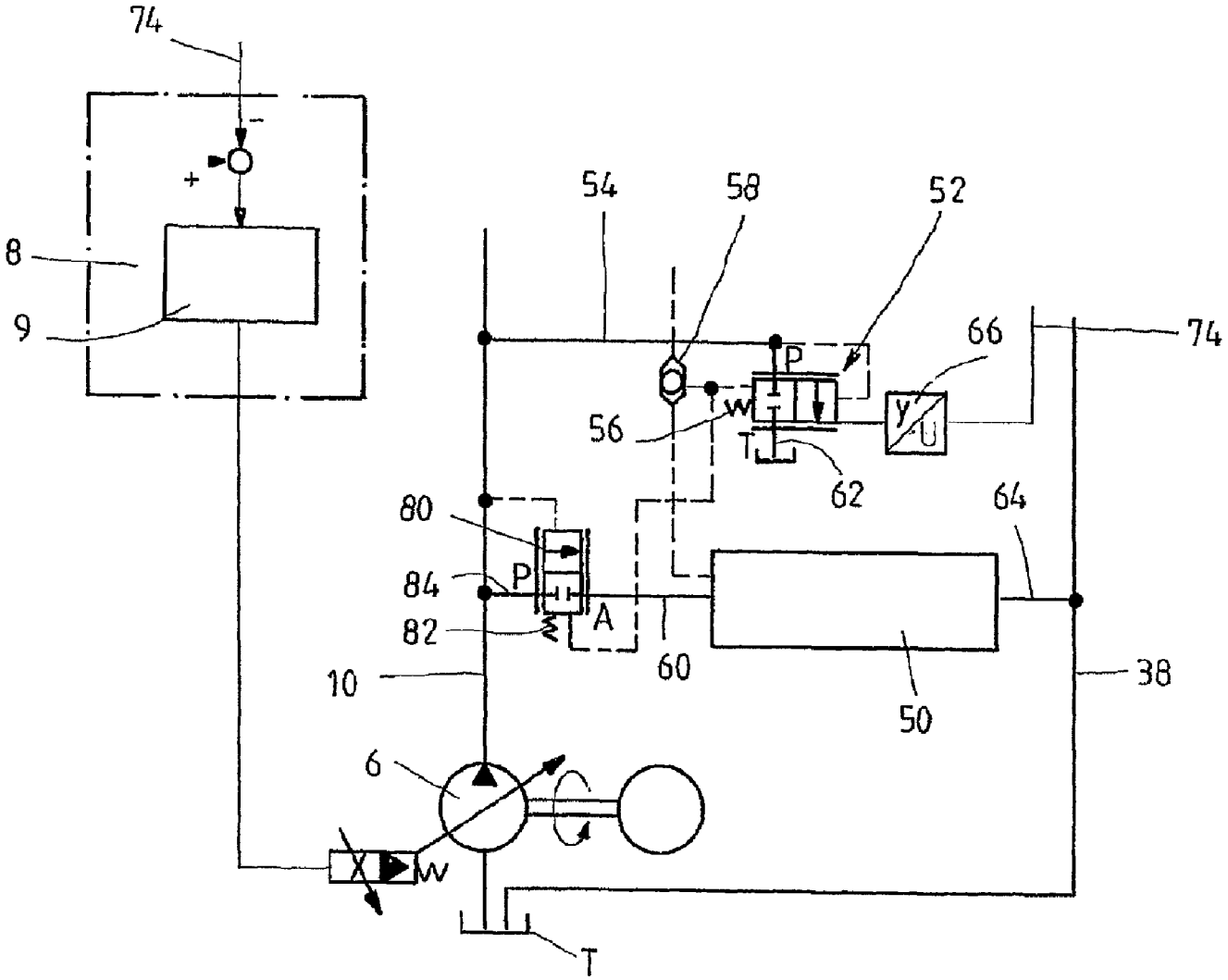
FIGS. 4 to 9 show embodiments in which the hydraulic fluid supply of the power beyond consumer or consumers is carried out by means of a respective power beyond pressure scale.

FIG. 4 shows a variant of the control arrangement 1 in which the input pressure scale 52 is a 2/2 port directional pressure scale, the input port P being connected, as in the above-described embodiments, to the branch line 54 and the tank port T opening into the tank via the tank duct 62. The pressure prevailing at the input port P is applied to the input pressure scale 52 in the opening direction and the force of the spring 56 as well as the greatest of the load pressures prevailing at the output of the pressure scale shuttle valve 58 are applied thereto in the closing direction. The travel distance of the pressure scale valve slide is detected, in turn, by a distance sensor 66 and is used for controlling the pump 6.

In accordance with FIG. 4, the power beyond consumer 50 is supplied with hydraulic fluid via the power beyond pressure scale 80 to which the pressure prevailing in the pump line 10 is applied in the opening direction and the force of the pressure scale spring 82 as well as the greatest of the load pressures tapped off at the output of the pressure scale shuttle valve 58 are applied in the closing direction. The power beyond pressure scale 80 is disposed in a power beyond feed line 84 branching off the pump line 10.

In this variant the input pressure scale 52 and the power beyond pressure scale 80 are arranged in parallel and are each in the form of a 2/2 port directional pressure scale. The opening pressure $\Delta p_{EDW}$ of the input pressure scale is greater than that of the power beyond pressure scale 80 ($\Delta p_{IDW3}$) and the two individual pressure scales 40, 42 ($\Delta p_{IDW1,\ 2}$), wherein either the opening pressure of the two individual pressure scales 40, 42 or that of the power beyond pressure scale 80 can be selected to be greater so as to determine a priority treatment. That is to say, first the power beyond consumer 50 or the working hydraulics of the tractor (cylinders 2, 4) can be supplied with hydraulic fluid. In this embodiment, too, a supply of all consumers 2, 4, 50 is ensured when the pump 6 is adjusted such that a residual volume flow drains toward the tank T via the input pressure scale 52.

Figure 5:
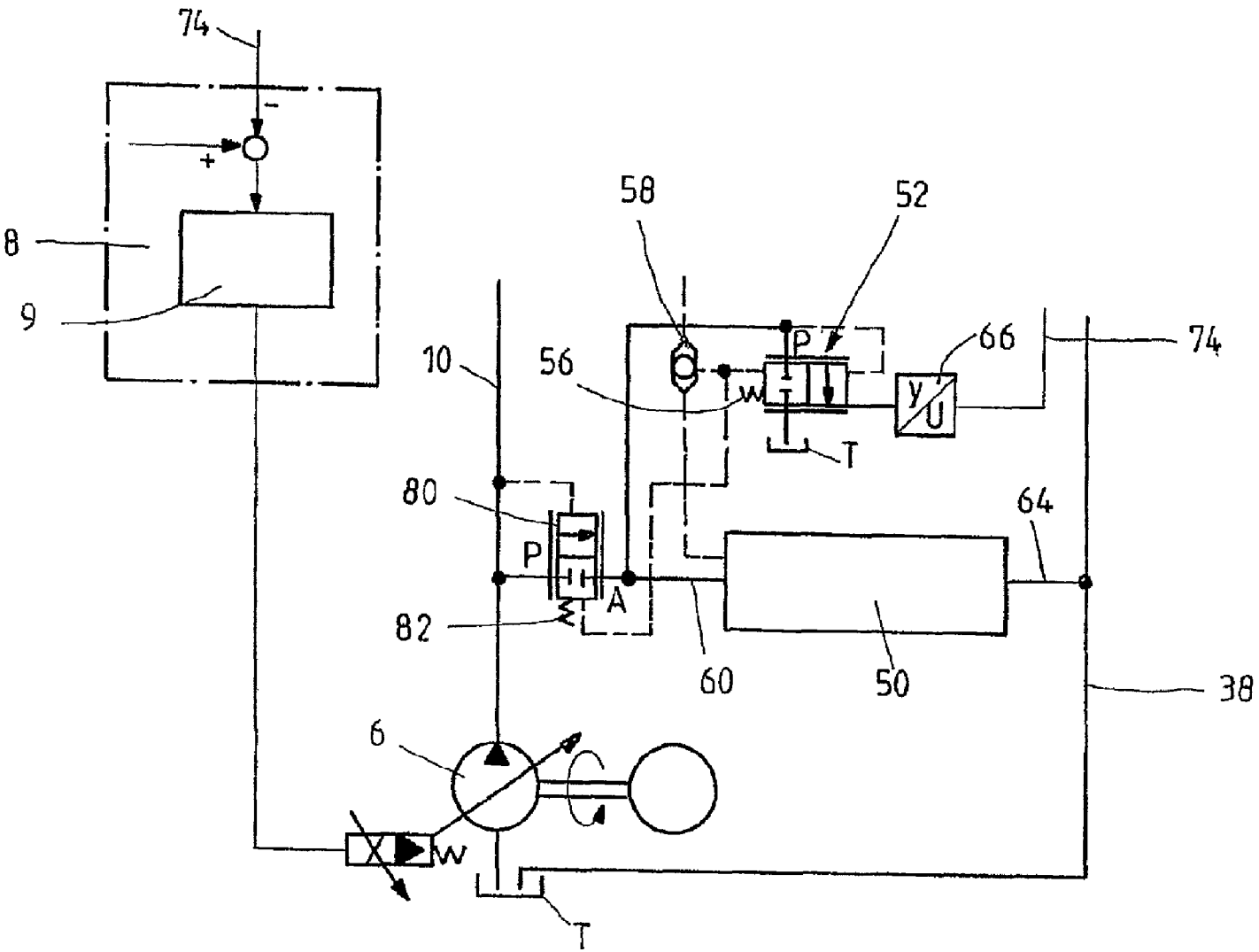

In FIG. 5 a variant of the embodiment shown in FIG. 4 is illustrated, wherein the input pressure scale 52 is not connected in parallel—as in FIG. 4—but in series with the power beyond pressure scale 80. That is to say, the branch line 54 leading to the input port P of the input pressure scale 52 does not branch off the pump line 10 but off the feed duct 60 connecting the output port A of the power beyond pressure scale 80 and the power beyond consumer 50. Thus, the input pressure scale 52 is supplied with hydraulic fluid only after opening the power beyond pressure scale 80. Both pressure scales 52, 80 are in the form of a 2/2 port directional pressure scale and are biased by means of the greatest of the load pressures in the closing position and by the respective pressure prevailing at the input P in the opening position. Depending on the selection of the pressure scale springs 44, 46, 82 and the spring 56 of the input pressure scale, priority can be given either to the power beyond consumer 50 or to the consumers 2, 4. The opening pressure difference of the input pressure scale 52 again is greater than the opening pressure difference of the individual pressure scales 40, 42 and the power beyond pressure scale 80. For the rest, the function corresponds to that of the embodiment from FIG. 4.

Figure 6:
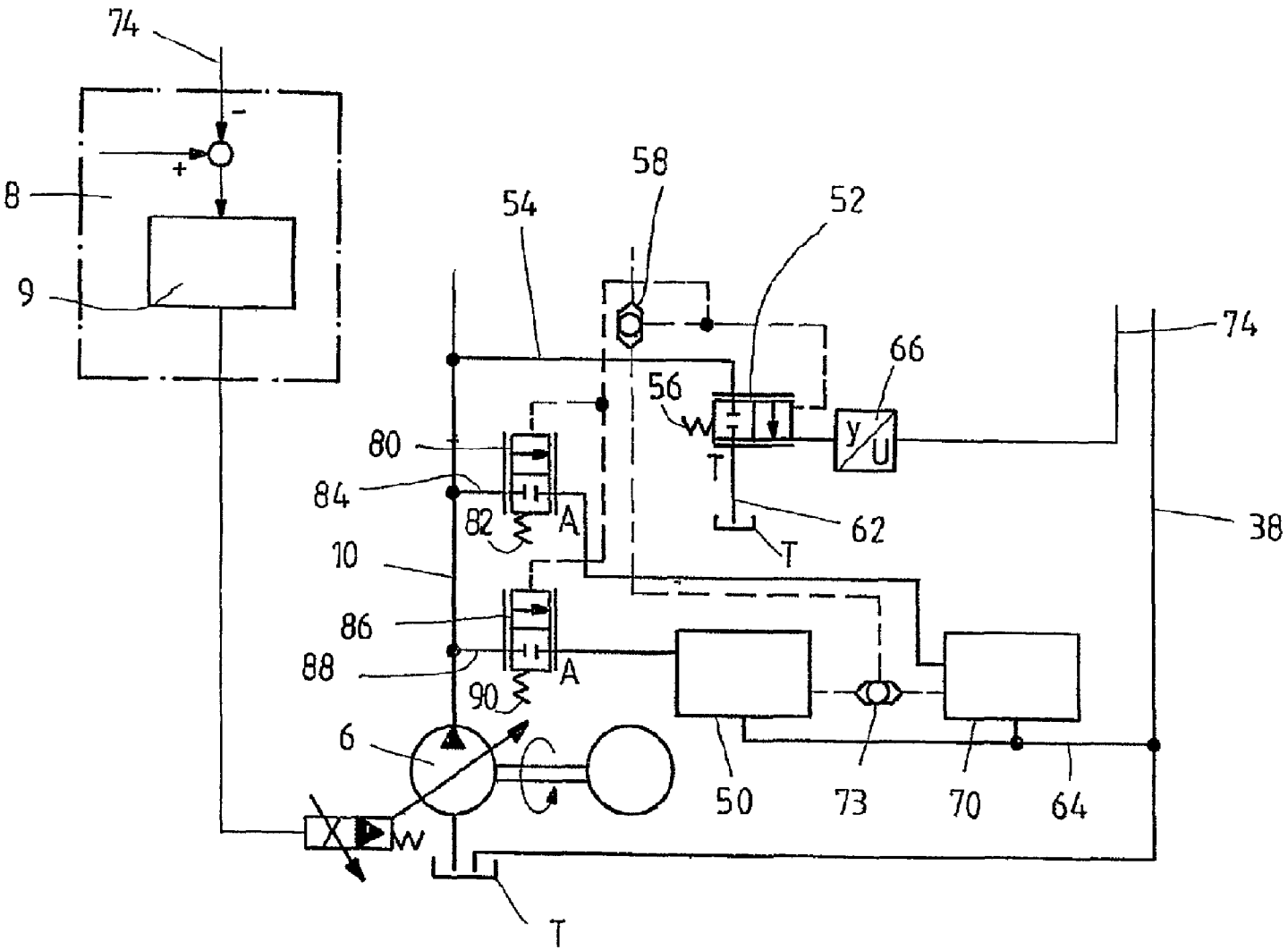

In FIG. 6 an embodiment is shown in which two power beyond consumers 50, 70 are to be supplied with hydraulic fluid. To each of them a power beyond pressure scale 80 and 86 is allocated which are connected to the allocated power beyond consumers 50, 70 via respective power beyond feed lines 84, 88 branching off the pump line 10.

Each of the two power beyond pressure scales 80, 86 and the input pressure scale 52 are 2/2 port directional pressure scales. In this embodiment the input pressure scale 52 is biased in the opening direction by the greatest of the load pressures tapped off via the pressure scale shuttle valve 58, while in the closing direction merely the spring 56 acts. The output port of the input pressure scale 52 is connected to the tank T by means of the tank duct 62. Also the two power beyond pressure scales 80, 86 are biased merely by the force of a pressure scale spring 82 or 90 in the closing direction, while in this embodiment the greatest of the load pressures tapped off at the output of the pressure scale shuttle valve 58 acts in the opening direction.

This embodiment permits a plurality of operational sequences, because, depending on the selected spring of the individual pressure scales 40, 42 and the power beyond pressure scales 80, 86, either the working hydraulics of the tractor (consumers 2, 4) and then the power beyond consumers 50, 70 or vice versa or else first only either of the power beyond consumers, then the working hydraulics and then the other power beyond consumer 70, 50 can be supplied with hydraulic fluid.

In accordance with the pump control and the hydraulic fluid required, when the input pressure scale 52 is opened a residual volume flow will occur and in response to said residual volume flow or to the position of the pressure scale piston of the input pressure scale 52 the pump 6 is controlled so as to avoid a lack of supply.

Figure 7:
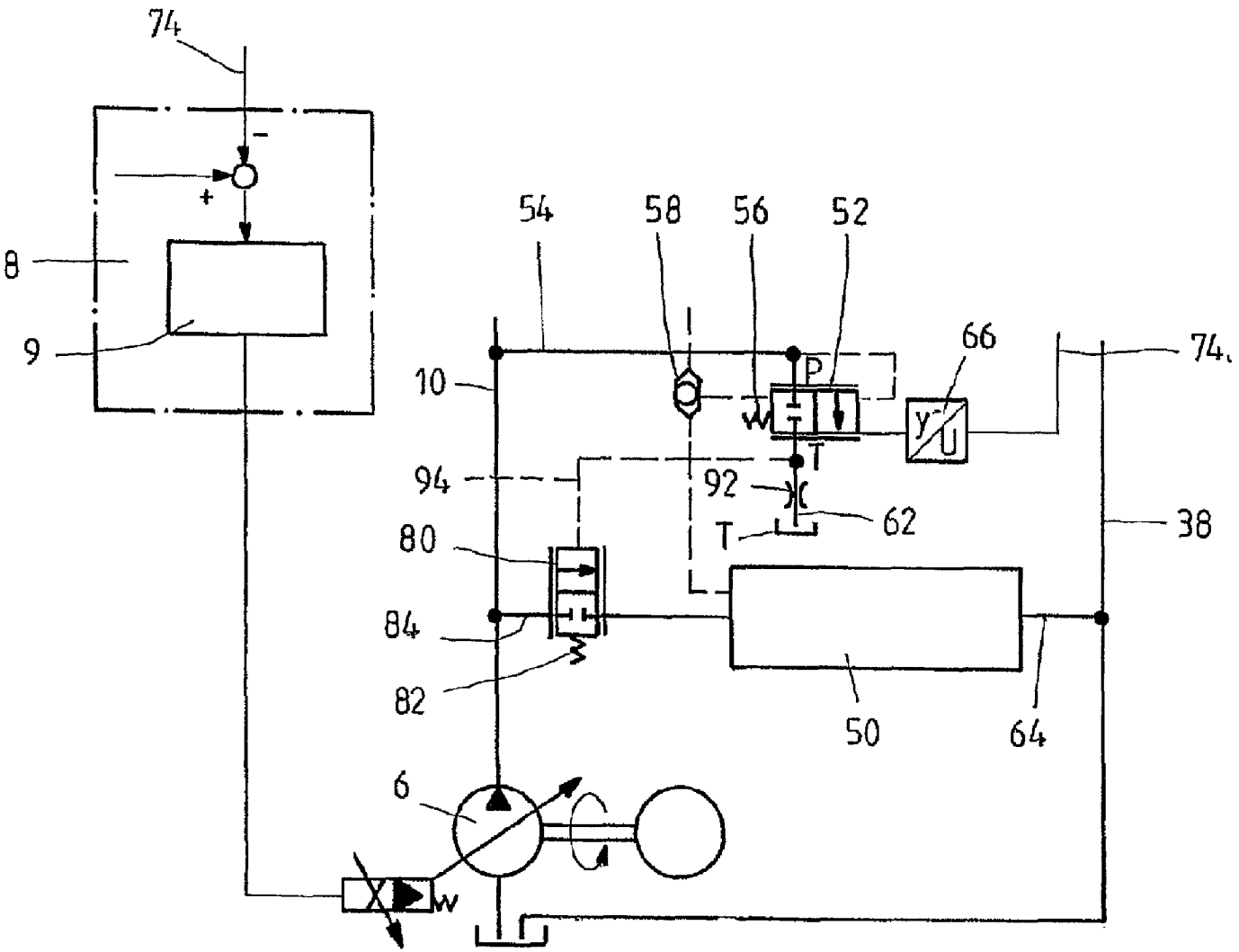

In FIG. 7 an embodiment comprising a port of a power beyond consumer 50 is shown which corresponds to that of FIG. 4 in its basic structure. In this solution, too, the power beyond consumer 50 is supplied with hydraulic fluid via a power beyond pressure scale 80 disposed in a power beyond feed line 84. The input pressure scale 52 is arranged in the branch line 54 and in the opening direction the pressure prevailing in said branch line 54 is applied thereto, while the force of the spring 56 and the greatest load pressure tapped off at the pressure scale shuttle valve 58 act in the closing direction. In contrast to the embodiment according to FIG. 4, in the tank duct 62 connected to the output port T of the input pressure scale 52 a diaphragm 92 is provided by means of which a control pressure tapped off via a control line 94 and guided to the control surface of the power beyond pressure scale 80 active in the opening direction is generated in a residual volume flow draining toward the tank T. The force of the spring 82 is applied to said power beyond pressure scale in the closing direction. In this variant, first the consumers 2, 4 of the working hydraulics are supplied with hydraulic fluid and only after an increase in the residual volume flow and a corresponding pressure drop in the tank duct 62 the power beyond pressure scale 80 is opened so that then the power beyond consumer 50 is supplied with hydraulic fluid. As in the case of all above-described embodiments, the residual volume flow toward the tank T is used for controlling the pump when it exceeds a predetermined magnitude.

In a failsafe case the residual volume flow is drained toward the tank via the input pressure scale 52 in order to avoid undesired high pressure drops at the diaphragm 92 by means of a biasing valve switched in parallel to the diaphragm 92.

In this embodiment, too, the opening pressure of the individual pressure scale 40, 42 of the working hydraulics is adjusted to be greater than the opening pressure of the power beyond pressure scale 80 and the opening pressure of the input pressure scale 52 is preferably selected—as in all embodiments—to be greater than that of the individual or power beyond pressure scales.

Figure 8:
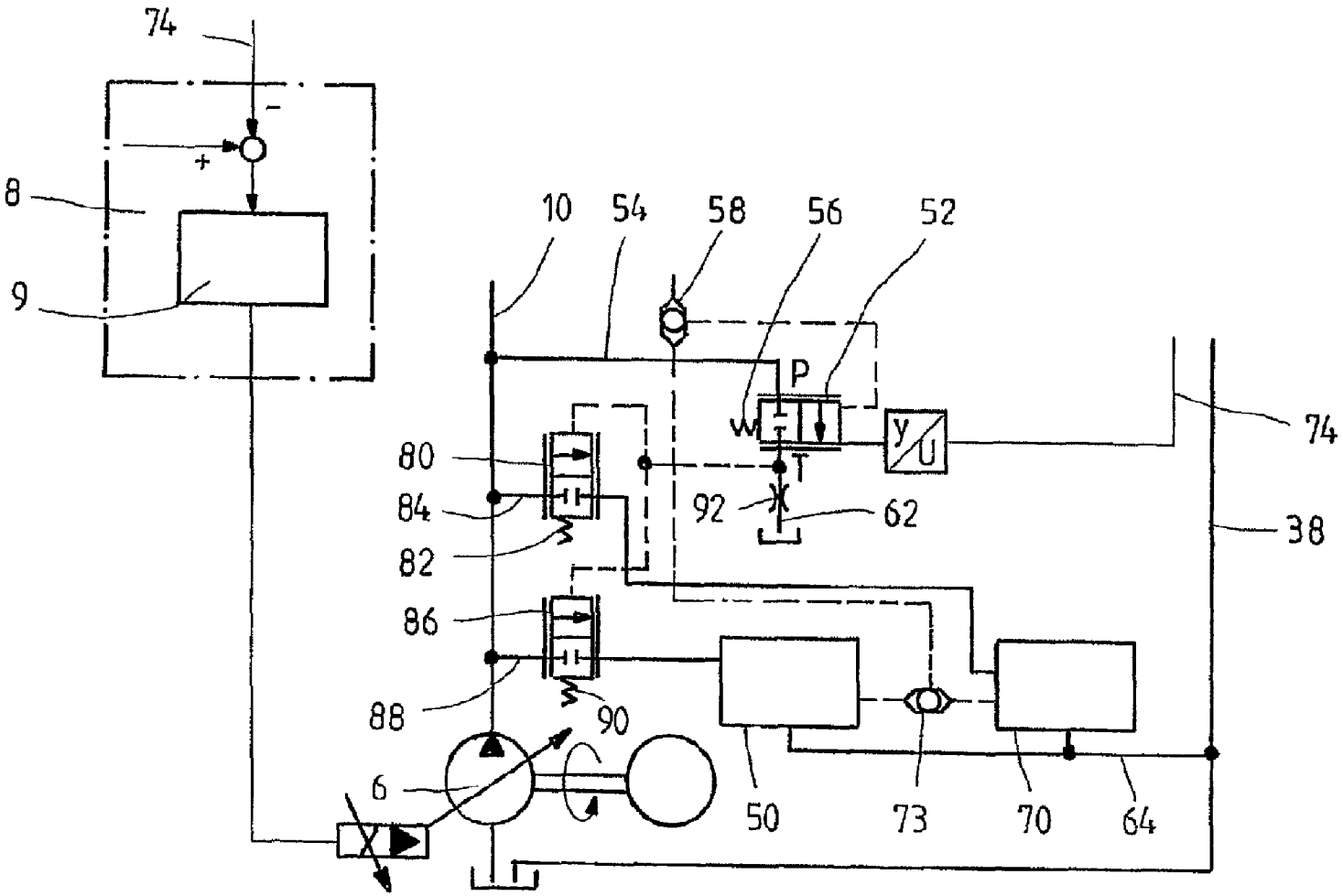

Finally FIG. 8 illustrates an embodiment in which the principle of controlling a number of power beyond consumers 50, 70 explained by way of FIG. 7 is used. To each of the two power beyond consumers 50, 70 respective power beyond pressure scales 80, 86 are allocated which are disposed in power beyond feed lines 84 or 88 branching off the pump line 10 and via which the two power beyond consumers 50, 70 are supplied with hydraulic fluid. The input pressure scale 52 is designed and interconnected just as in the afore-described embodiment, wherein again in the tank duct 62 the diaphragm 92 generating a control pressure for controlling the two power beyond pressure scales 80, 86 is provided. Also in this embodiment initially the consumers 2, 4 of the working hydraulics of the tractor are supplied with hydraulic fluid; the two power beyond consumers 50, 70 are supplied with hydraulic fluid only when a sufficient control pressure is built up upstream of the diaphragm 92. However, priority can be given to one of the two power beyond consumers 50, 70 by appropriate selection of the pressure scale springs 82, 90.

The concept according to the invention permits to connect power beyond consumers in a simple manner and to guarantee a desired hydraulic fluid supply of all consumers even under unfavorable operating conditions (for instance low load pressure, high hydraulic fluid volume flow).

The power beyond port can be realized by comparatively few component parts, wherein in the embodiments according to FIGS. 1 to 8 the pressure scale designs (DW) listed in the following table are used. In said table DW means: pressure scale, PB: power beyond consumer and Δp: the respective opening pressure of the pressure scales, the indices EDW marking the input pressure scale, IDW 1, 2 marking the individual pressure scales of the working hydraulics and IDW 3, 4 marking the power beyond pressure scales.

When designing the component parts in accordance with the table, the selection of the spring forces or the opening pressure differences of the individual pressure scales having the indices 1 and 2 and, where appropriate, 3 and 4 is exchangeable, which in particular cases may result in different priority treatments of the consumers 2, 4 and the power beyond consumers 50, 70.

Basically, also a direct control of a power beyond consumer 50, 70 without a separate valve is possible in connection with electric directional control valves 16, 18. The hydraulic fluid volume flow to the power beyond consumer 50, 70 results from the difference of the adjusted pump volume flow and the hydraulic fluid volume flows adjusted at the working ports of the directional control valves 16, 18 in normal operation, i.e. when the pump is adjusted correctly in accordance with the input pressure scale 52.

TABLE

| FIG. | Pressure scales 52, 80, 86 | 1PB | 2PB | Opening pressure ratios of EDW (52) and IDWs (40, 42, 80, 86) |
|---|---|---|---|---|
| 1 | 1 × 3/3 DW | x | | $\Delta p_{EDW} > \Delta p_{IDW1,2}$ |
| 2 | 1 × 4/4 DW | | x | $\Delta p_{EDW} > \Delta p_{IDW1,2}$ |
| 3 | 1 × 3/3 12/2 DW | | | $\Delta p_{EDW} > \Delta p_{IDW1,2} > \Delta p_{IDW3}$ |
| 4 | 2 × 2/2 DW parallel | x | | $\Delta p_{EDW} > \Delta p_{IDW3} > \Delta p_{IDW1,2}$<br>$\Delta p_{EDW} > \Delta p_{IDW1,2} > \Delta p_{IDW3}$ |
| 5 | 2 × 2/2 DW series | x | | $\Delta p_{EDW} > \Delta p_{IDW3} > p_{IDW1,2}$<br>$\Delta p_{EDW} > \Delta p_{IDW1,2} > \Delta p_{IDW3}$ |
| 6 | 3 × 2/2 DW parallel | | x | $\Delta p_{EDW} > \Delta p_{IDW3,4} > \Delta p_{IDW1,2}$<br>$\Delta p_{EDW} > \Delta p_{IDW1,2} > \Delta p_{IDW3,4}$<br>$\Delta p_{EDW} > \Delta p_{IDW3} > \Delta p_{IDW1,2} > \Delta p_{IDW4}$<br>$\Delta p_{EDW} > \Delta p_{IDW1} > \Delta p_{IDW3,4} > \Delta p_{IDW2}$<br>$\Delta p_{EDW} > \Delta p_{IDW1} > \Delta p_{IDW3} > \Delta p_{IDW2} > \Delta p_{IDW4}$<br>$\Delta p_{EDW} > \Delta p_{IDW3} > \Delta p_{IDW1} > \Delta p_{IDW4} > \Delta p_{IDW2}$ |
| 7 | Diaphragm and 1 × 2/2 DW | x | | $\Delta p_{EDW} > \Delta p_{IDW1,2} > \Delta p_{IDW3}$ |
| 8 | Diaphragm and 1 × 2/2 DW | | x | $\Delta p_{EDW} > \Delta p_{IDW1,2}$; $\Delta p_{IDW3/4}$ independently of $\Delta p_{IDW1,2}$ |

Moreover especially in case of a lack of supply with electrically controlled valves a flow management is possible. E.g. when priority is given to the power beyond consumers, the other consumers can be withdrawn so far, where appropriate, that the power beyond consumer is always optimally supplied. This is visible from the loading signal or the residual volume flow via the input pressure scale 52.

Figure 9:
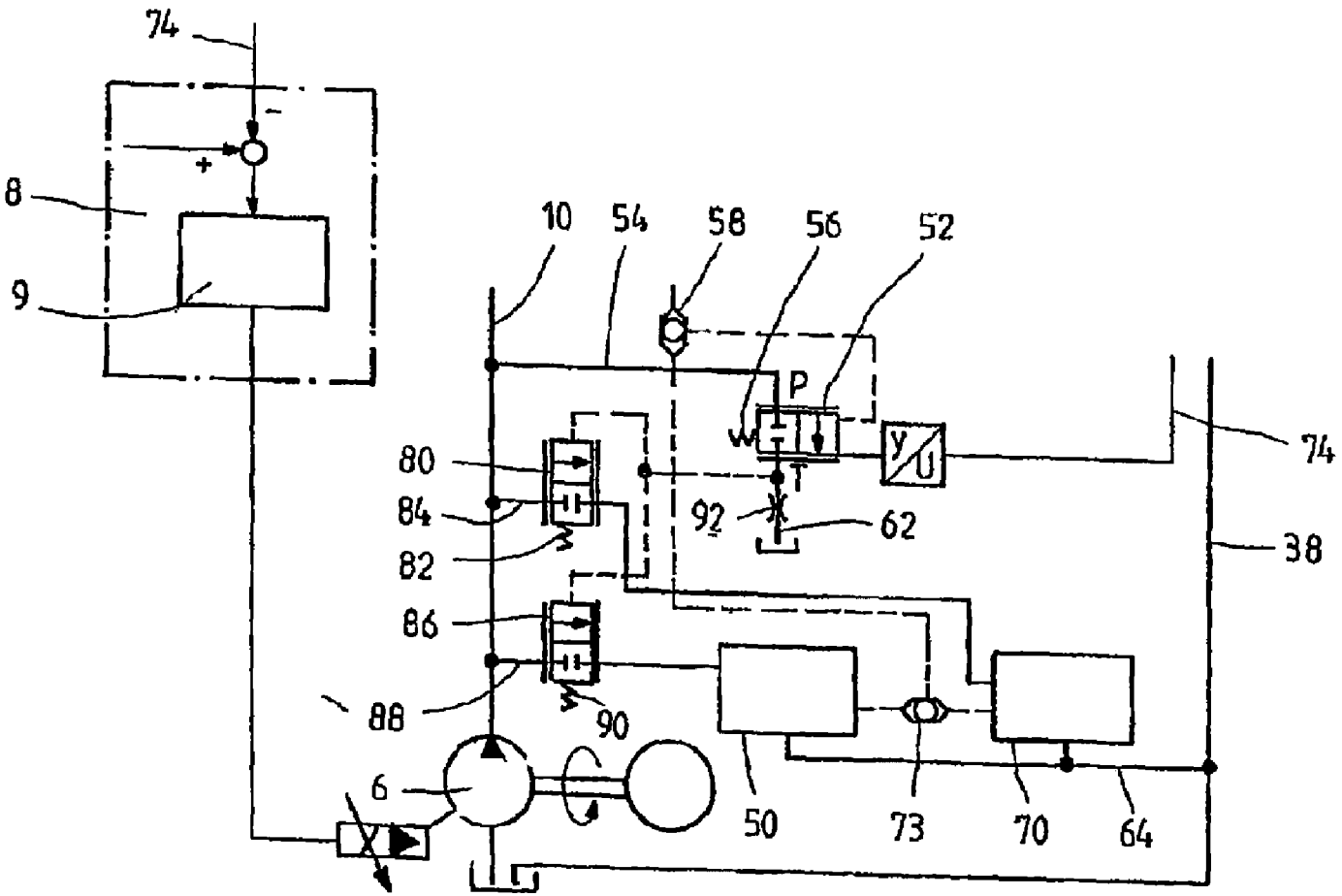

The use of the invention is possible upon use of electrically adjustable control pumps as well as speed-controlled constant-displacement pumps (FIG. 9), especially in connection with open center and LS valves which are actuated mechanically, electrically or electro-hydraulically. On principle, the invention is suited for all applications of working hydraulics in mobile hydraulic systems whose consumers are not fixed from the beginning.

The invention discloses a hydraulic control arrangement for controlling a number of consumers, particularly of a mobile working machine. In addition to the consumers of the control arrangement, a power beyond consumer should be able to be connected to a power beyond port. All consumers and power beyond consumers are supplied with hydraulic fluid by a pump. An input pressure scale is provided downstream of the pump, and the greater of the load pressures of the consumers or of the at least one power beyond consumer is applied to the control port of said input pressure scale.

We claim:

1. A hydraulic control arrangement for controlling a number of consumers, particularly of a mobile working machine, which can be supplied with hydraulic fluid by means of a variable-displacement pump downstream of which an input pressure scale is arranged for opening a connection to a tank, wherein an adjustable metering orifice is allocated to each consumer, and comprising a power beyond port to which at least one power beyond consumer can be connected, characterized in that the input pressure scale is adjusted in response to the greatest one of the load pressures of the consumers and the at least one power beyond consumer, wherein the power beyond consumer can be supplied with hydraulic fluid via the input pressure scale and the greatest one of the load pressures is applied to the input pressure scale in the closing direction, wherein in a spring-biased home position the input pressure scale blocks the connection to the power beyond consumer and to the tank and upon adjusting into the opening direction first opens the connection to the power beyond consumer and then to the tank, and wherein a second power beyond consumer is connected which can be supplied with hydraulic fluid via the input pressure scale after the first power beyond consumer.

2. A hydraulic control arrangement for controlling a number of consumers, particularly of a mobile working machine, which can be supplied with hydraulic fluid by means of a variable-displacement pump downstream of which an input pressure scale is arranged for opening a connection to a tank, wherein an adjustable metering orifice is allocated to each consumer, and comprising a power beyond port to which at least one power beyond consumer can be connected, characterized in that the input pressure scale is adjusted in response to the greatest one of the load pressures of the consumers and the at least one power beyond consumer, wherein the power beyond consumer can be supplied with hydraulic fluid via the input pressure scale and the greatest one of the load pressures is applied to the input pressure scale in the closing direction, wherein in a spring-biased home position the input pressure scale blocks the connection to the power beyond consumer and to the tank and upon adjusting into the opening direction first opens the connection to the power beyond consumer and then to the tank, and wherein a second power beyond consumer is connected which can be supplied with hydraulic fluid via the input pressure scale simultaneously with or after the first power beyond consumer, and wherein a power beyond pressure scale to which the force of a spring and the same control pressure as to the input pressure scale are applied in the closing direction and the pressure prevailing at its input port is applied in the opening direction is arranged upstream of the second power beyond pressure scale.

3. A hydraulic control arrangement for controlling a number of consumers, particularly of a mobile working machine, which can be supplied with hydraulic fluid by means of a pump downstream of which an input pressure scale is arranged for opening a connection to a tank, wherein an adjustable metering orifice is allocated to each consumer, and comprising a power beyond port to which at least one power beyond consumer can be connected, characterized in that the input pressure scale is adjusted in response to the greatest one of the load pressures of the consumers and the at least one power beyond consumer, wherein at least one power beyond consumer can be supplied with hydraulic fluid via a power beyond pressure scale while bypassing the input pressure scale.

4. A control arrangement according to claim 3, wherein the greatest one of the load pressures and the force of a spring are applied to the input pressure scale in the closing direction and the pressure prevailing at the input thereof is applied to the input pressure scale in the opening direction.

5. A control arrangement according to claim 4, wherein the greatest one of the load pressures and the force of a spring are applied to the power beyond pressure scale in the closing direction.

6. A control arrangement according to claim 5, wherein the input pressure scale is connected in series downstream of the power beyond pressure scale.

7. A control arrangement according to claim 4, wherein a diaphragm is disposed downstream of the input pressure scale in a tank line leading to the tank and the pressure acting in the opening direction upon the at least one power beyond pressure scale is tapped off between the diaphragm and the input pressure scale, wherein the force of a spring is applied to the power beyond pressure scale in the closing direction.

8. A control arrangement according to claim 3, wherein the greatest one of the load pressures is applied to the input pressure scale in the opening direction.

9. A control arrangement according to claim 8, wherein the greatest one of the load pressures is applied in the opening direction and the force of a spring is applied in the closing direction to at least one power beyond pressure scale.

10. A control arrangement according to claim 3, wherein the pump is adapted to be controlled in response to the adjustment of the input pressure scale.

11. A control arrangement according to claim 3, wherein the pump is an electrically controllable variable-displacement pump or a speed-controlled constant-displacement pump.

12. A control arrangement according to claim 3, wherein an individual pressure scale to which a pressure scale spring and the respective load pressure of the consumers are applied in the opening direction and the pressure prevailing at the output of the individual pressure scale is applied in the closing direction is disposed upstream of each metering orifice.

13. A control arrangement according to claim 12, wherein the pressure scale springs of the individual pressure scales and the power beyond pressure scales or of the input pressure scale are adapted to each other in such a manner that priority is given either to consumers or to power beyond consumers.

14. A control arrangement according to claim 13, wherein the opening pressure difference of the input pressure scale is selected to be greater than the opening pressure difference of the individual pressure scales or the power beyond pressure scales.

15. A control arrangement according to claim 3, wherein the metering orifices are formed by electrically, hydraulically or mechanically adjustable directional control valves.

16. A control arrangement according to claim 3, comprising a pressure scale shuttle valve to the input of which on the one hand the greatest load pressure of the consumers and, on the other hand, the greatest load pressure of the power beyond consumer or consumers is applied and the output of which is connected to a control chamber of the input pressure scale.

17. A control method for a hydraulic control arrangement according to claim 3, wherein the pump and the metering orifices of the consumers are controlled such that a predetermined residual volume flow to the tank is resulting when the at least one power beyond consumer is supplied with hydraulic fluid via the input pressure scale.

18. A control method according to claim 17, wherein the pump is adjusted in response to the residual volume flow or the position of a pressure scale slide of the input pressure scale.

* * * * *